US005710488A

United States Patent [19]

Nilssen

[11] Patent Number: 5,710,488

[45] Date of Patent: Jan. 20, 1998

[54] LOW-FREQUENCY HIGH-EFFICACY ELECTRONIC BALLAST

[76] Inventor: Ole K. Nilssen, 408 Caesar Dr., Barrington, Ill. 60010

[21] Appl. No.: 859,616

[22] Filed: Mar. 23, 1992

Related U.S. Application Data

[63] Continuation of Ser. No. 503,094, Apr. 2, 1990, abandoned, which is a continuation of Ser. No. 944,191, Dec. 22, 1986, abandoned.

[51] Int. Cl.[6] ..... H05B 41/36

[52] U.S. Cl. ..... 315/224; 315/200 R; 315/307; 315/DIG. 4; 315/DIG. 5; 315/DIG. 7

[58] Field of Search ..... 315/DIG. 7, DIG. 5, 315/DIG. 4, 158, 157, 200 R, 151, 163, 165, 166, 307, 310, 224

[56] References Cited

U.S. PATENT DOCUMENTS

| | | | |
|---|---|---|---|
| 3,432,725 | 3/1969 | Roich | 315/307 |
| 3,514,668 | 5/1970 | Johnson et al. | 315/307 |
| 4,009,387 | 2/1977 | Nuver | 315/158 |
| 4,187,448 | 2/1980 | Kuroi et al. | 315/176 |
| 4,207,497 | 6/1980 | Capewell et al. | 315/224 X |
| 4,207,498 | 6/1980 | Spira et al. | 315/97 |
| 4,430,628 | 2/1984 | Nilssen | 315/DIG. 5 |
| 4,464,606 | 8/1984 | Kane | 315/224 X |
| 4,464,610 | 8/1984 | Pitel | 315/291 |
| 4,508,996 | 4/1985 | Clegg et al. | 315/224 |
| 4,614,897 | 9/1986 | Kumbatovic | 315/307 X |
| 4,667,131 | 5/1987 | Nilssen | 315/307 X |
| 4,808,887 | 2/1989 | Fähnrich et al. | 315/224 X |
| 4,888,524 | 12/1989 | Ganser et al. | 315/224 X |
| 4,888,525 | 12/1989 | Nilssen | 315/224 X |
| 4,894,587 | 1/1990 | Jungreis et al. | 315/224 X |

*Primary Examiner*—Do Hyun Yoo

[57] ABSTRACT

A bridge rectifier is connected with a 277Volt/60 Hz power line and provides full-wave-rectified unfiltered DC voltage to a series-combination of: i) an inductor, ii) a full bridge inverter switched in synchronism with the 60 Hz power line voltage, and iii) an electronic switching device. A fluorescent lamp is connected with the inverter's output and receives 60 Hz current of exceptionally low crest-factor, thereby operating at an exceptionally high efficacy. The electronic switching device is normally in a fully conductive state. However, it is controlled—by a photo sensor responsive to the light output of the fluorescent lamp—in such a manner that whenever the instantaneous light output exceeds a certain adjustably predetermined upper level, it switches into a non-conductive state where it remains until the instantaneous light output level diminishes to a certain adjustably predetermined lower level. Whenever the electronic switching device is switched off while current flows through the inductor, a flywheel diode shunts the current away from the switching device and into an energy-storing capacitor, the DC voltage on which is used for filling-in the valleys between the individual 120 Hz DC pulses on the unfiltered power supply.

12 Claims, 2 Drawing Sheets

LOW-FREQUENCY HIGH-EFFICACY ELECTRONIC BALLAST

This application is a continuation of parent application Ser. No. 07/503,094, filed 2 Apr. 1990, now abandoned, which is a continuation of Ser. No. 06/944,191, filed 22 Dec. 1986, now abandoned.

BACKGROUND OF THE INVENTION

1. Field of Invention

The invention relates to ballasts for gas discharge lamps, particularly of a kind wherein: i) the lamps are powered with a relatively low frequency current, and ii) the instantaneous lamp light output flux is maintained substantially constant.

2. Elements of Prior Art

It is well known that significant improvements in overall cost-effectivity of the lighting function can result from appropriately controlling the level of light output from lighting fixtures used for general lighting in offices and the like.

Fluorescent lamp ballasting systems adapted to permit control of light output level on a systems basis presently do exist—as for instance in accordance with U.S. Pat. Nos. 4,207,498 and 4,350,935 to Spira et al.

However, there are significant complexities associated with practical applications of such light level control systems; and, in spite of the very significant improvements potentially available in overall lighting efficacy, such light control systems have not gained wide acceptance.

3. Inventive Rationale

Much of the value available from a light control system may be attained by control of each individual lamp. That way, for instance, light output from each fixture could be kept constant irrespective of any variations in the magnitude of the power line voltage and/or regardless of changes in luminous efficacy of the fluorescent lamp(s).

To make this kind of approach commercially feasible, the present invention provides for a ballast comprising its own individual light sensing means which is so positioned and arranged that, when this ballast is built into a lighting fixture, its light sensor intercepts a part of the light produced by the lamp(s) powered by the ballast and then causes the lamp current to be controlled in such manner as to maintain the lamp light output at a desired level.

Moreover, additional efficacy improvement is attained by powering the lamps in such manner as to keep the instantaneous light flux output from each individual lamp at a substantially constant level; which is to say, by minimizing the amount of flicker—even if that flicker is non-perceivable to the normal human eye.

SUMMARY OF THE INVENTION

Objects of the Invention

A first object of the present invention is that of providing means whereby the light output level of a gas discharge lamp means may be effectively controlled.

A second object is that of providing a ballast comprising means for sensing the light output produced by the gas discharge lamp powered by that ballast, thereby automatically to control that light output in accordance with a desired purpose.

A third object is that of providing means by which to control the magnitude of the current in a gas discharge lamp such as to maintain its absolute magnitude at an adjustably presetable substantially constant level.

A fourth object is that of providing a ballast operable to power a fluorescent lamp with a current having a particularly low crest-factor.

A fifth object is that of providing a power-line-operated electronic ballast operable to power a gas discharge lamp with 60 Hz current, yet providing improved lamp efficacy.

These as well as several other objects, features and advantages of the present invention will become apparent from the following description and claims.

Brief Description

In its preferred embodiment, the present invention comprises a rectifier means connected with a 277Volt/60 Hz power line and operative to provide full-wave-rectified unfiltered DC voltage to a series-combination of: i) an inductor, ii) a full bridge inverter switched in synchronism with the 60 Hz power line voltage, and iii) an electronic switching means.

A fluorescent lamp is connected with the inverter's output and receives 60 Hz current of exceptionally low crest-factor, thereby operating at an exceptionally high efficacy.

The electronic switching means is normally in a fully conductive state. However, it is controlled—by a photo sensor responsive to the light output of the fluorescent lamp—in such a manner that whenever the instantaneous light output exceeds a certain adjustably predetermined upper level, it switches into a non-conductive state where it remains until the instantaneous light output level diminishes to a certain adjustably predetermined lower level, at which point it switches back into its normally fully conductive state.

Whenever the electronic switching means is switched off while current flows through the inductor, a flywheel diode shunts the current away from the switch means and into an energy-storing capacitor, the DC voltage on which is used for filling-in the valleys between the individual 120 Hz DC pulses on the unfiltered power supply.

By suitable choice of lamp operating voltage, the DC voltage on the energy-storing capacitor can be arranged to be about half the peak mangitude of the power line voltage, in which case power is drawn from the power line with both high power factor as well as good suppression of third harmonics.

DESCRIPTION OF THE PREFERRED EMBODIMENT

Description of the Drawings

Figure 1:
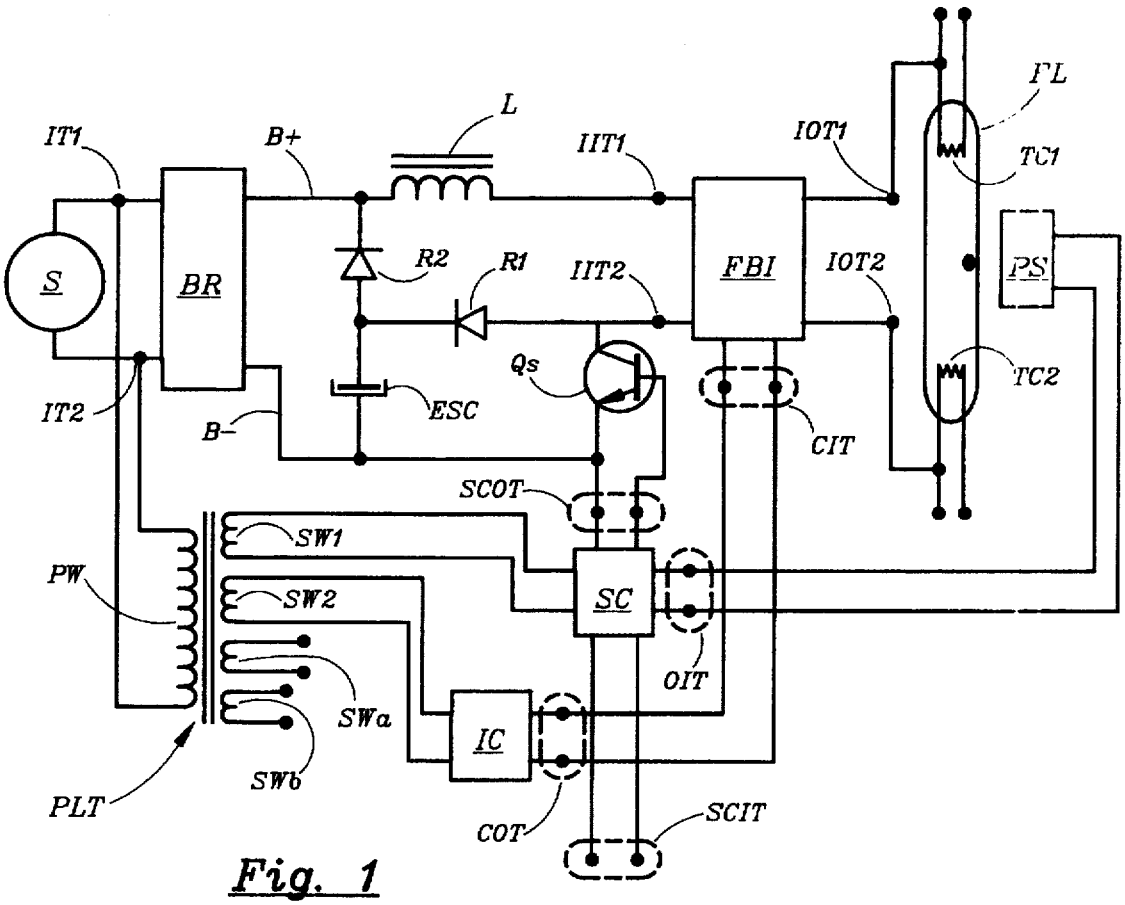
FIG. 1 schematically illustrates the preferred embodiment of the invention.

In FIG. 1, a source S of 277Volt/60 Hz voltage is applied to input terminals IT1 and IT2 of a bridge rectifier BR, the unidirectional voltage output of which is applied directly between a B+ bus and a B− bus, with the positive voltage being connected to the B+ bus.

Between the B+ bus and a first inverter input terminal IIT1 of a full bridge inverter FBI is connected an inductor L.

A switching transistor Qs is connected with its collector to a second inverter input terminal IIT2 and with its emitter to the B– bus. A first rectifier R1 is connected with its anode to inverter input terminal IIT2 and with its cathode to the anode of a second rectifier R2. The cathode of rectifier R2 is connected with the B+ bus. An energy-storing capacitor ESC is connected between the cathode of rectifier R1 and the B– bus.

The output from inverter FBI is provided across inverter output terminals IOT1 and IOT2; which are respectively connected with thermionic cathodes TC1 and TC2 of a fluorescent lamp FL. Inverter FBI has a pair of control input terminals CIT connected with control output terminals COT of an inverter controller IC.

A switch controller SC has: i) a pair of switch controller output terminals SCOT connected between the base and the emitter of switching transistor Qs, ii) a pair of switch controller input terminals SCIT, and iii) a pair of opto-input terminals OIT connected with a photo-sensor PS.

Switch controller SC and inverter controller IC are respectively connected with a first secondary winding SW1 and a second secondary winding SW2 of a power line transformer PLT; which power line transformer has two additional secondary windings SWa and SWb which, each connected with one of thermionic cathodes. TC1 and TC2 of fluorescent lamp FL. Power line transformer PLT has a primary winding PW connected between input terminals IT1 and IT2 of bridge rectifier BR.

Figure 2:
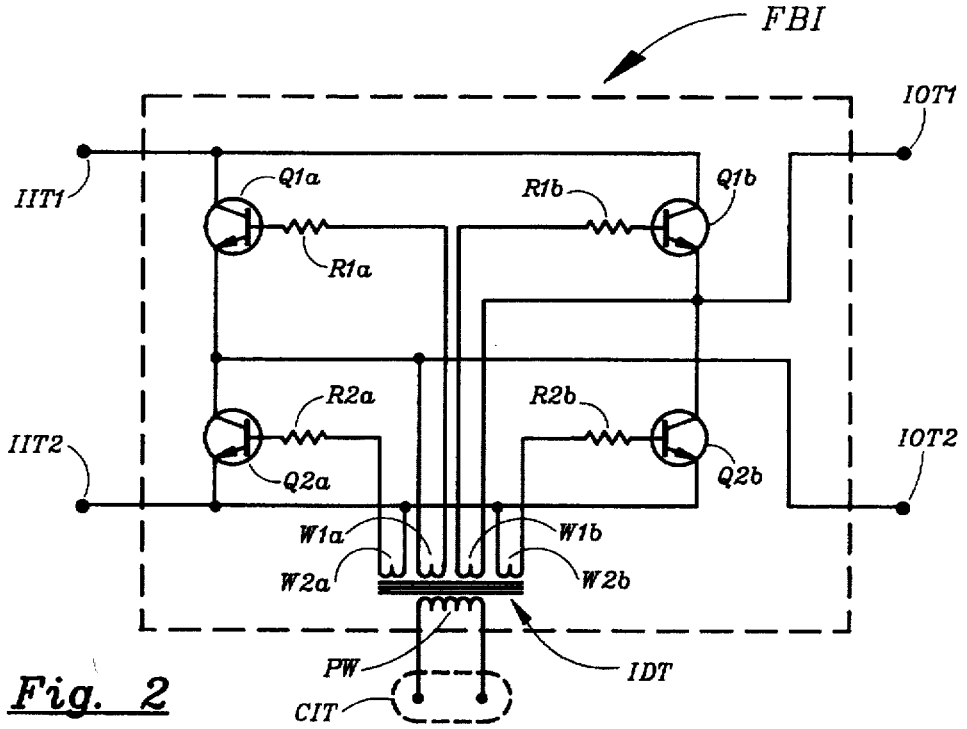
FIG. 2 provides details of the full bridge inverter used in the arrangement of FIG. 1.

FIG. 2 illustrates key details of full bridge inverter FBI.

In FIG. 2, a first transistor Q1*a* is connected with its collector to inverter input terminal IIT1 and with its emitter to the collector of a second transistor Q2*a*, whose emitter is connected with inverter input terminal IIT2. A third transistor Q1*b* is similarly connected with its collector to inverter input terminal IIT1 and with its emitter to the collector of a fourth transistor Q2*b*, whose emitter is connected with inverter input terminal IIT2.

Control input terminals CIT of inverter FBI are connected with primary winding PW of an inverter drive transformer IDT. This transformer has four secondary windings W1*a*, W2*a*, W1*b* and W2*b*; which windings are connected with the base-emitter junctions of transistors Q1*a*, Q2*a*, Q1*b* and Q2*b* by way of resistors R1*a*, R2*a*, R1*b* and R2*b*; all respectively.

Details of Operation

Figure 3:
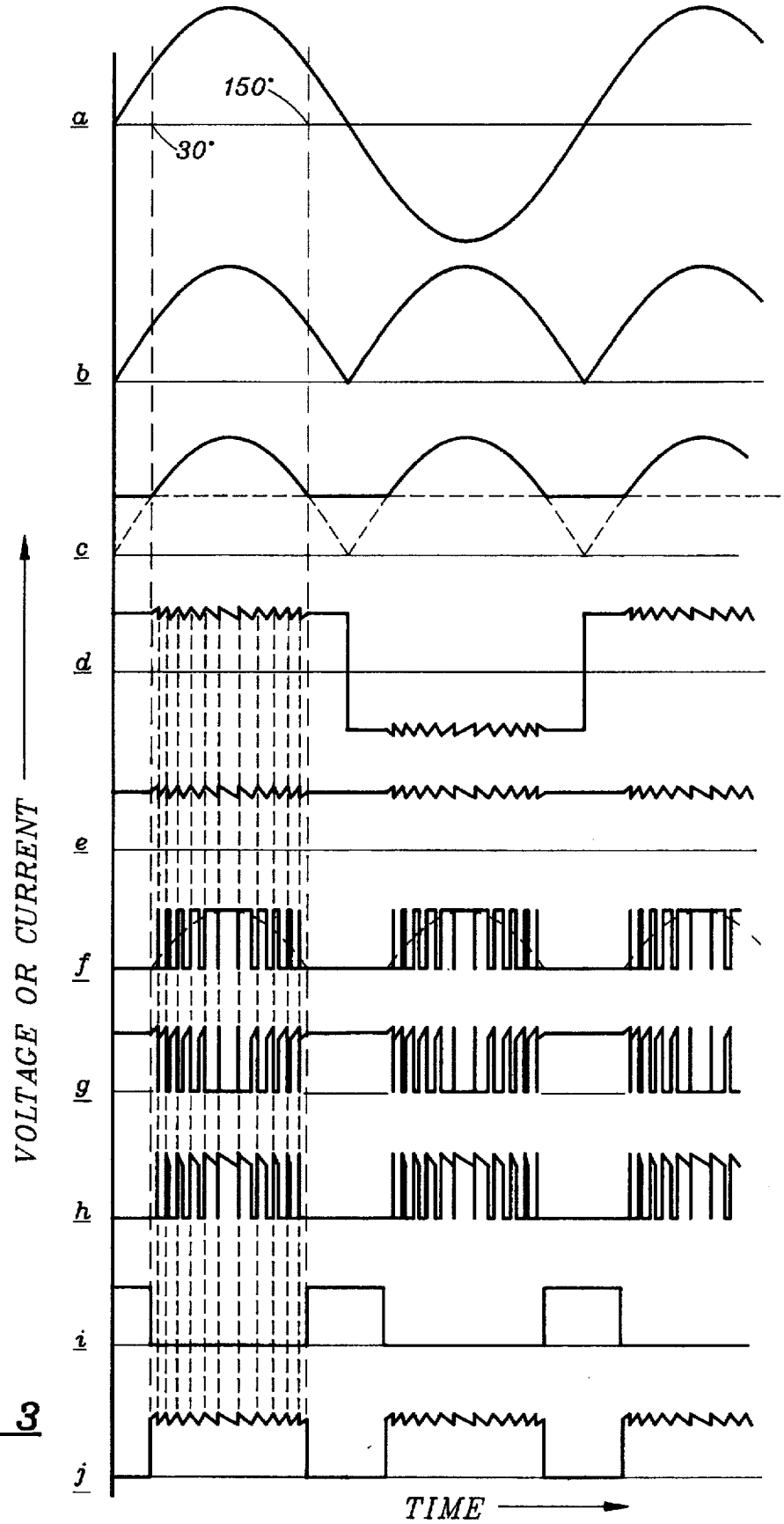
FIG. 3 illustrates various voltage and current waveforms associated with the operation of the preferred embodiment.

The operation of the ballast arrangement of FIG. 1 may best be understood when reading the following explanation in light of the waveforms illustrated by FIG. 3.

FIG. 3*a* illustrates the waveform of the power line voltage present between input terminals IT1 and IT2; which waveform is identical to the waveform of the voltage applied across fluorescent lamp FL before lamp ignition.

FIG. 3*b* illustrates the pulsed DC voltage resulting from full-wave-rectification of the power line voltage of FIG. 3*a*.

FIG. 3*c* illustrates the waveform of the net DC voltage present between the B– bus and the B+ bus after the fluorescent lamp has ignited and is in stable operation.

FIG. 3*d* illustrates the waveform of the current flowing through the fluorescent lamp during normal operation.

FIG. 3*e* indicates the instantaneous magnitude of the light flux emitted from fluorescent lamp FL. In addition, in rough approximation, FIG. 3*e* indicates the absolute value of the magnitude of the voltage across fluorescent lamp FL.

FIG. 3*f* indicates the waveform of the voltage present across switching transistor Qs.

FIG. 3*g* indicates the current flowing through switching transistor Qs.

FIG. 3*h* indicates the current flowing into energy-storing capacitor ESC through R1.

FIG. 3*i* indicates the current drawn from energy-storing capacitor ESC through rectifier R2.

FIG. 3*j* indicates the waveform of the current drawn from the power line by bridge rectifier BR.

The details of operation of the circuit of FIG. 1 may now be explained as follows.

In FIG. 1, the source S represents an ordinary electric utility power line, the 277Volt/60 Hz power line voltage from which (see FIG. 3*a*) is applied directly to the bridge rectifier (BR). This bridge rectifier is of conventional construction and provides for the full-wave-rectified power line voltage (see FIG. 3*b*) to be applied to the circuit by way of the B+ bus and the B– bus.

As soon as the power line voltage is connected with input terminals IT1 and IT2, cathode heating voltages are applied to thermionic cathodes TC1 and TC2, thereby bringing these cathodes to incandescence within about 1.5 seconds. Hence, the fluorescent lamp is ready to be ignited in rapid-start manner within about 1.5 second after initial application of power line voltage.

Also, as long as power line voltage is provided to input terminals IT1/IT2, power is provided to switch controller SC and inverter controller IC by way of secondary windings SW1 and SW2, respectively, of power line transformer PLT.

The inverter controller (IC) is operative to convert the 60 Hz sinusoidal voltage received from secondary winding SW2 to a 60 Hz squarewave voltage, which is provided at its output terminals COT and thereby to the primary winding of inverter drive transformer IDT. In turn, by way of transformer IDT, the base-emitter junctions of transistors Q1*a*, Q2*a*, Q1*b* and Q2*b* is provided with a squarewave current-limited voltage drive—with resistors R1*a*, R2*a*, R1*b* and R2*b* acting as the current-limiting means. Thus, as long as the arrangement of FIG. 1 is connected with the power line, inverter FBI operates to invert in complete synchrony with the frequency of the power line voltage.

The switch controller (SC) is operable to provide a control voltage to switching transistor Qs such as to cause it to enter its fully conductive state, where it will remain until the output from the photo sensor (PS) reaches a certain predetermined upper magnitude. At that point, the switch controller abruptly reverses the control voltage supplied to the switching transistor such as to cause it to enter its non-conductive state, where it will remains until the output from the photo sensor decreases by at least a relatively small percentage from this certain predetermined upper level to a certain predetermined lower level. The certain predetermined upper level is adjustably controllable (i.e., setable) by provision of a control signal to switch controller input terminals SCIT; the magnitude-ratio between the certain upper level and the certain lower level remaining approximately constant.

Before the fluorescent lamp ignites (which is to say, before significant lamp current flows), the voltage on energy-storing capacitor ESC is zero. Moreover, since the lamp then provides no light output, the switching transistor (Qs) exists in its fully conductive state. Thus, with the inverter (FBI) providing for full-wave inversion of the voltage applied to it, the starting voltage applied to the fluorescent lamp (FL) is substantially identical to the power line voltage applied between input terminals IT1 and IT2 (see FIG. 3*a*).

As the fluorescent lamp ignites, lamp current starts flowing and light starts being provided by the lamp. After a few milliseconds (the exact length of time being principally determined by the magnitude of the supply voltage and the inductance of the current-limiting inductor (L), the lamp's light output level reaches the certain predetermined upper level, at which point switching transistor Qs switches into its non-conductive state. After this point, the lamp current continues to flow through rectifier R1 and into the energy-storing capacitor (ESC); which then starts to charge up, eventually reaching the point at which its voltage becomes so high as to cause the magnitude of the lamp current to diminish—eventually to reach the certain predetermined lower level, thereby to cause switching transistor Qs to switch back into its fully conductive state.

After the above-described initial starting period, during which light output from the fluorescent lamp will have exceeded its normally maximum instantaneous light output level for a brief period, operation of the circuit arrangement of FIG. 1 settles into a steady state characterized by the waveforms of FIG. 3 and otherwise explained as follows.

1. The magnitude of the DC voltage on energy-storing capacitor ESC will be substantially constant and approximately equal to the difference between: i) the peak magnitude of the voltage provided from bridge rectifier BR (see FIG. 3*b*), and ii) the average of the absolute magnitude of the voltage present across the fluorescent lamp. In the preferred embodiment, the fluorescent lamp actually consists of a special 96"/T12 rapid-start fluorescent lamp, and the average absolute magnitude of the lamp voltage is about 196 Volt. With the power line voltage being 277Volt/60 Hz, the peak magnitude of the voltage provided from the bridge rectifier is about 392 Volt; which means that the magnitude of the substantially constant DC voltage on energy-storing capacitor ESC is also about 196 Volt. Thus, as indicated in FIG. 3*c*, the DC voltage actually provided between the B– bus and the B+ bus is the higher of: i) the instantaneous magnitude of the full-wave-rectified power line voltage, and ii) the substantially constant magnitude of the DC voltage on energy-storing capacitor ESC.

2. The current flowing through the fluorescent lamp will be as indicated in FIG. 3*d*; which waveform, in terms of absolute magnitude, correlates closely with the instantaneous magnitude of the luminous flux emitted from the fluorescent lamp, as indicated in FIG. 3*e*. Moreover, the details of the waveform of the luminous flux emitted from the fluorescent lamp correlates with the waveform of the voltage across switching transistor Qs as interpreted in correlation with the waveform of the inverter's DC supply voltage of FIG. 3*c*.

3. The waveform of the current drawn from the power line is indicated in FIG. 3*j* and is seen to be of substantially constant magnitude between 30 degrees and 150 degrees of each half-cycle of the power line voltage. Consequently, there is substantially no third harmonic content in the current waveform; which fact is important in most installations of fluorescent lighting systems. The reason that current is drawn from the power line only during this particular interval relates to the fact that the magnitude of the DC voltage on energy-storing capacitor ESC is about half that of the peak magnitude of the power line voltage. With that being the case, the instantaneous magnitude of the full-wave-rectified power line voltage starts exceeding the magnitude of the voltage on capacitor ESC at about 30 degrees; and it starts falling below the magnitude of the capacitor voltage at about 150 degrees. Moreover, with the particular waveform of FIG. 3*j*, the power factor with which power is drawn from the power line is relatively high at about 85%.

From an overall functional viewpoint, the steady-state operation of the circuit of FIG. 1 may be explained as follows.

Whenever the magnitude of the DC voltage applied between the B– bus and the B+ bus exceeds the magnitude of the voltage across the fluorescent lamp, and as long as switching transistor Qs is in its fully conductive state, there is a net forward voltage present across inductor L; which means that the current through inductor L (and thereby through the fluorescent lamp) will increase. As this inductor/lamp current increases, so—within a few micro-seconds—does the lamp light output; and a point is soon reached at which the lamp light output becomes large enough to make the output from photo sensor PS such as to cause the switch controller to cause the switching transistor to switch into its non-conductive state.

After that point, the inductor/lamp current continues to flow, except that this current now has to flow into capacitor ESC. In doing so, the current must overcome both the lamp voltage as well as the DC voltage on capacitor ESC, the sum of whose magnitudes exceeds the instantaneous magnitude of the voltage present between the B– bus and the B+ bus. Thus, there is a net reverse voltage present across inductor L, which means that the magnitude of the inductor/lamp current will now start to decrease. As this inductor/lamp current decreases, so—within a few micro-seconds—does the lamp light output; and a point is soon reached at which the lamp light output becomes low enough to make the output from photo sensor PS such as to cause the switch controller to cause the switching transistor to switch back into its fully conductive state.

Thereafter, the cycle will repeat with a repetition rate depending on: i) the instantaneous magnitude of the DC voltage between the B– bus and the B+ bus, ii) the degree of hysteresis associated with the photo sensor and the switch controller, iii) the absolute magnitude of the voltage across the lamp, iv) the magnitude of the inductance of inductor L, and v) the delay between an increase/decrease in lamp current versus the corresponding increase/decrease in lamp light output.

Since the delay between the increase/decrease of lamp current versus the corresponding increase/decrease in lamp light output is less than about 25 micro-seconds for most ordinary fluorescent lamps, it is clearly necessary to make the time-period of each increase/decrease of inductor/lamp current substantially longer than about 25 micro-seconds; which means that it is necessary to make the inductance of inductor L large enough to cause detectable changes in current magnitude to occur over time-periods substantially longer than 25 micro-seconds.

Of course, the detectable changes in current magnitude depends directly on the detectable changes in the level of light flux output; which, in turn, depends on the specifications of the switch controller and particularly on the amount of hysteresis built thereinto. In the preferred embodiment, the sensitivity has been so arranged that the relative hysteresis-gap is about plus/minus 10%.

Thus, with reference to FIGS. 3*d*, 3*e*, and 3*j*, the indicated variations in magnitude stays within the band of ±10%.

Additional Comments a) The waveforms of FIG. 3 illustrate steady-state operation of the ballasting arrangement of FIG. 1 under the particular condition where the magnitude of the voltage-drop across the fluorescent lamp is approximately half the peak magnitude of the power line voltage; which condition represents a highly desirable situation and is in fact apporoximately attainable in many actual applications.

If the magnitude of the voltage-drop across the fluorescent lamp were to be substantially less than half the peak magnitude of the power line voltage, the result would be that: i) the magnitude of the DC voltage on capacitor ESC would increase, and ii) switching transistor Qs would be activated more frequently and even during the period when lamp power is being provided by the energy-storing capacitor, which is in contrast with the situation illustrated in FIG. 3.

On the other hand, if the magnitude of the voltage-drop across the fluorescent lamp were to be somewhat larger than half the peak magnitude of the power line voltage, the result would be that: i) the magnitude of the DC voltage on capacitor ESC would decrease, and ii) switching transistor Qs would be activated less frequently. However, for the ballast circuit to work at all, it is necessary that the magnitude of the voltage-drop across the lamp be no higher than the average magnitude of the voltage provided between the B– bus and the B+ bus; which, in the limiting case, means that the magnitude of the voltage-drop across the lamp can not exceed about 63% of the peak magnitude of the power line voltage.

In any case, as long as the peak magnitude of the power line voltage exceeds the magnitude of the voltage-drop across the fluorescent lamp by at least 58%, the ballasting circuit of FIG. 1 will automatically operate to properly power the fluorescent lamp.

b) When the magnitude of the voltage-drop across the lamp is significantly less than half the peak magnitude of the power line voltage, the conduction angle of the current drawn from the power line gets reduced; and the power factor with which the ballast draws power from the power line gets correspondingly reduced.

c) It is of course a simple matter to increase or decrease the magnitude of the voltage applied to the ballast input terminals IT1 and IT2. This can be done by auto-transformer action, using therefor a tapped primary winding on power line transformer PLT.

d) One of the major values provided by the ballasting arrangement of FIG. 1 is that of providing for gas in the fluorescent lamp to operate at an essentially constant level of ionization; which, in turn, results in several important values, such as: i) higher luminous efficacy, ii) longer lamp life, and iii) reduced flicker e) The degree of hysteresis built into the switch controller can be chosen at will over a wide range. However, in view of practical considerations, in the preferred embodiment, a relative hysteresis range of plus/minus 10% was chosen. This value is readily attainable by use of commonly available electronic components, such as the opto-actuated Schmitt trigger used in Motorola's H11L1 opto coupler/isolator.

f) Adjustment of the light level about which the automatic control takes place can readily be accomplished in Several ways.

For instance, the positioning of photo sensor PS relative to the fluorescent lamp determines how much of the lamp light flux it receives, thereby determining its control threshold.

Or, a shade can be used to block off more or less of the light flux reaching the photo sensor.

A more practical arrangement, however, is that of providing an adjustable bias to the trigger means (or hysteresis means) comprised within switch controller SC; which is indeed the arrangement used in the preferred embodiment.

g) Ordinarily, when a fluorescent lamp is initially provided with power, its light output will be substantially lower than it will be once the lamp has warmed up to proper operating temperature. The ballast of FIG. 1 provides compensation for this effect, in that the lamp will automatically be provided with substantially higher current as long as the light output is not up to the desired level.

h) An important value associated with providing automatic light output control as herein described relates to energy-efficiency beyond the point of simply making the lamp itself operate at a higher efficacy. For a specified level of light output, by automatically compensating for line voltage fluctuations and the naturally-occuring lamp light output deterioration over time, an overall additional efficiency-advantage of nearly 20% is attained.

i) It is believed that the present invention and its several attendant advantages and features will be understood from the preceeding description. However, without departing from the spirit of the invention, changes may be made in its form and in the construction and interrelationships of its component parts, the form herein presented merely representing the presently preferred embodiment.

I claim:

1. An arrangement comprising:

a source operative to provide an AC voltage at a pair of AC terminals; and a circuit connected with the AC terminals and operable to power a gas discharge lamp; the circuit being characterized by:

(i) providing a conditioned voltage at a pair of terminals; and (ii) including a transistor conducting intermittently at a time-varying switching frequency, thereby to maintain the absolute magnitude of the conditioned voltage substantially constant.

2. The arrangement of claim 1 wherein the switching frequency is:

(i) many times higher than the frequency of the AC voltage; and (ii) time-varying at a frequency equal to twice the frequency of the AC voltage.

3. The arrangement of claim 1 wherein the source is an ordinary electric utility power line.

4. The arrangement of claim 1 wherein the conditioned voltage is:

(i) an alternating voltage; and (ii) of frequency substantially lower than the switching frequency.

5. An arrangement comprising:

a source operative to provide an AC voltage at a pair of AC terminals; and a circuit connected with the AC terminals and operable to power a gas discharge lamp; the circuit being characterized by:

(i) providing a conditioned voltage at a pair of terminals; and (ii) including a transistor conducting intermittently with a time-varying duty-cycle at a switching frequency, thereby being operative to maintain the absolute magnitude of the conditioned voltage substantially constant.

6. The arrangement of claim 5 wherein:

(i) the switching frequency is many times higher than the frequency of the AC voltage; and (ii) the duty-cycle varies at a frequency equal to twice the frequency of the AC voltage.

7. The arrangement of claim 5 wherein the conditioned voltage is:

(i) an alternating voltage; and (ii) of frequency substantially lower than the switching frequency.

8. An arrangement comprising:

a source providing an AC voltage at a pair of AC terminals; and an assembly of electrical components connected with the AC terminals and characterized by:

(i) including a gas discharge lamp;

(ii) providing an output voltage from a pair of output terminals; and (iii) including a transistor conducting intermittently at a time-varying switching frequency, thereby to maintain the absolute magnitude of the output voltage substantially constant.

9. The arrangement of claim 8 wherein an electrical conduction path exists, at least at certain times, between one of the output terminals and one of the AC terminals.

10. The arrangement of claim 8 wherein the assembly is additionally characterized by including an energy-storing inductor.

11. The arrangement of claim 8 wherein the gas discharge lamp is a fluorescent lamp operating at a substantially constant level of ionization.

12. An arrangement comprising:

a source providing an AC voltage at a pair of AC terminals; and an assembly of electrical components and parts connected with the AC terminals and characterized by:

(i) including a gas discharge lamp;

(ii) being operable to power the gas discharge lamp at a substantially constant level of ionization, thereby causing the lamp to emit a substantially constant level of light output;

(iii) providing an output voltage at a pair of output terminals; and (iv) including a transistor conducting intermittently at a time-varying switching frequency, thereby to maintain the absolute magnitude of the output voltage substantially constant.

* * * * *